US006612476B2

(12) United States Patent
Smolinski

(10) Patent No.: US 6,612,476 B2
(45) Date of Patent: Sep. 2, 2003

(54) FASTENER DRIVING TOOL WITH MODULAR CONSTRUCTION

(75) Inventor: Darek Smolinski, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 90 days.

(21) Appl. No.: 10/046,483

(22) Filed: Jan. 14, 2002

(65) Prior Publication Data

US 2003/0132264 A1 Jul. 17, 2003

(51) Int. Cl.[7] ..... B25C 1/04

(52) U.S. Cl. ..... 227/120; 227/130; 227/156; 173/170

(58) Field of Search ..... 227/120, 131, 227/132, 134, 130, 156; 173/162.2, 170

(56) References Cited

U.S. PATENT DOCUMENTS

| | | | | | |
|---|---|---|---|---|---|
| 4,005,812 | A | | 2/1977 | Doyle et al. | |
| 4,305,541 | A | * | 12/1981 | Barrett et al. | 227/120 |
| 4,375,867 | A | * | 3/1983 | Novak et al. | 227/131 |
| 4,450,998 | A | * | 5/1984 | Ruskin | 227/156 |
| 4,629,108 | A | * | 12/1986 | Judge | 227/132 |
| 4,700,876 | A | | 10/1987 | Wingert | |
| 5,036,926 | A | | 8/1991 | Cavedo | |
| 5,186,714 | A | | 2/1993 | Boudreault et al. | |
| 5,332,156 | A | | 7/1994 | Wheeler | |
| 5,347,684 | A | | 9/1994 | Jackson | |
| 5,353,474 | A | | 10/1994 | Good et al. | |
| 5,531,538 | A | | 7/1996 | Stolzer | |
| D393,194 | S | | 4/1998 | Hogue et al. | |
| D395,387 | S | | 6/1998 | Snider | |
| 5,785,230 | A | * | 7/1998 | Davignon et al. | 227/120 |
| 5,954,142 | A | | 9/1999 | Rahm | |
| D420,879 | S | | 2/2000 | Watson et al. | |
| 6,082,468 | A | | 7/2000 | Pusateri et al. | |
| 6,155,354 | A | | 12/2000 | Pusateri et al. | |
| 6,176,412 | B1 | | 1/2001 | Weinger et al. | |
| 6,179,192 | B1 | | 1/2001 | Weinger et al. | |
| 6,230,367 | B1 | | 5/2001 | Riedl | |
| 6,422,447 | B1 | * | 7/2002 | White et al. | 227/120 |

* cited by examiner

*Primary Examiner*—Scott A. Smith
(74) *Attorney, Agent, or Firm*—Lisa M. Soltis; Mark W. Croll; Donald J. Breh

(57) ABSTRACT

A fastener driving tool includes a housing enclosing a fastener driving portion and a handle connected to the fastener driving portion. A pair of clamshells is configured to form an ergonomic grip over the handle and also forming a fastener magazine, such that the ergonomic grip and the magazine are integral in each clamshell. The clamshells are secured to the fastener driving portion and an endcap without the use of special fasteners. A belt hook is available which releasably attaches to either side of the tool.

15 Claims, 4 Drawing Sheets

FASTENER DRIVING TOOL WITH MODULAR CONSTRUCTION

BACKGROUND OF THE INVENTION

The present invention relates generally to fastener driving tools operated by pneumatic, combustion, electric or powder-activated power, and more specifically to such a tool having a simplified construction.

Fastener driving tools of this type, and particularly pneumatically powered tools, include a metal housing and a separate magazine portion, made of plastic or metal, which is attached at respective ends to the main housing and the handle. Typically, fasteners are employed in this attachment, which adds cost and assembly time to the manufacturing process.

Another design factor of such fastener driving tools is that ergonomics plays a large part in the configuration of the tool. Users often grasp the tools for extended periods during the day, or at least for long periods of intermittent use. As such, the balance and grip of the tool are significant to user satisfaction. Ideally, the tool should be easy to hold without slipping. In the case of conventional pneumatic tools, the handle is a generally cylindrical metal tube which also functions as part of the pressurized air conduit. By the same token, this type of handle construction lacks the ergonomic and positive gripping qualities users desire. Supplemental resilient or rubber-like sleeves or grips have been provided for pneumatic power tools, as described in U.S. Pat. Nos. 5,332,156 and 5,954,142. However, a drawback of such grips is that, in some cases, the resilient grip sleeve can rotate relative to the handle.

Combustion-powered fastener driving tools are known with molded housing halves, as disclosed in commonly-assigned U.S. Pat. No. 6,176,412, which is incorporated by reference here. In such tools, each housing half includes a portion of the main fastener driving portion, the handle and the magazine. This type of construction is not as suitable for pneumatic tools, where metallic construction is used to accommodate the relatively high operational pressures.

Another design criteria of fastener driving tools is that when not in use, the user often needs to hang the tool on his belt or on other objects such as ladders, scaffolding or the like at a jobsite. In the case of tools used to install molding, chair rails and other trim, it is important to be able to maneuver the tool into tight places. As such, large protruding hooks are undesirable. A related objective is to be able to hang the tool from either tool side, depending on the job situation and whether the user is right or left-handed.

Accordingly, it is a first object of the present invention to provide an improved fastener driving tool construction featuring a combined handle grip which adds gripping comfort and adhesion to an existing tool handle.

A related object of the present invention is to provide an ergonomic grip as described above which is provided with an integral fastener magazine to reduce assembly costs.

Another object of the present invention is to provide an improved fastener driving tool featuring a removable belt hook which is mountable on either side of the tool.

BRIEF SUMMARY OF THE INVENTION

The above-listed objects are met or exceeded by the present fastener driving tool, which features a supplemental overgrip or ergonomic grip which fits over an existing handle of the tool. It is preferred that the ergonomic grip and a magazine are formed in a single pair of clamshells which overlie the handle. To facilitate the gripping of the ergonomic handle, a resilient gripping portion is provided and is located between the handle and the ergonomic grip so that resilient material projects through openings in the ergonomic grip. Also, the clamshells are secured to the tool without the use of designated fasteners. An optional belt hook is provided which releasably clamps to either side of the tool for use by right and left-handed users, especially where worksite maneuvering space is at a premium.

More specifically, the present invention provides a fastener driving tool including a housing including a fastener driving portion and a handle connected to the fastener driving portion. A pair of clamshells is provided which are configured to form an ergonomic grip over the handle and also forming a fastener magazine, such that the ergonomic grip and the magazine are integral in each clamshell. The clamshells are secured to the tool by an endcap without the use of special fasteners. A belt hook is available which releasably attaches to either side of the tool.

DETAILED DESCRIPTION OF THE INVENTION

Figure 1:
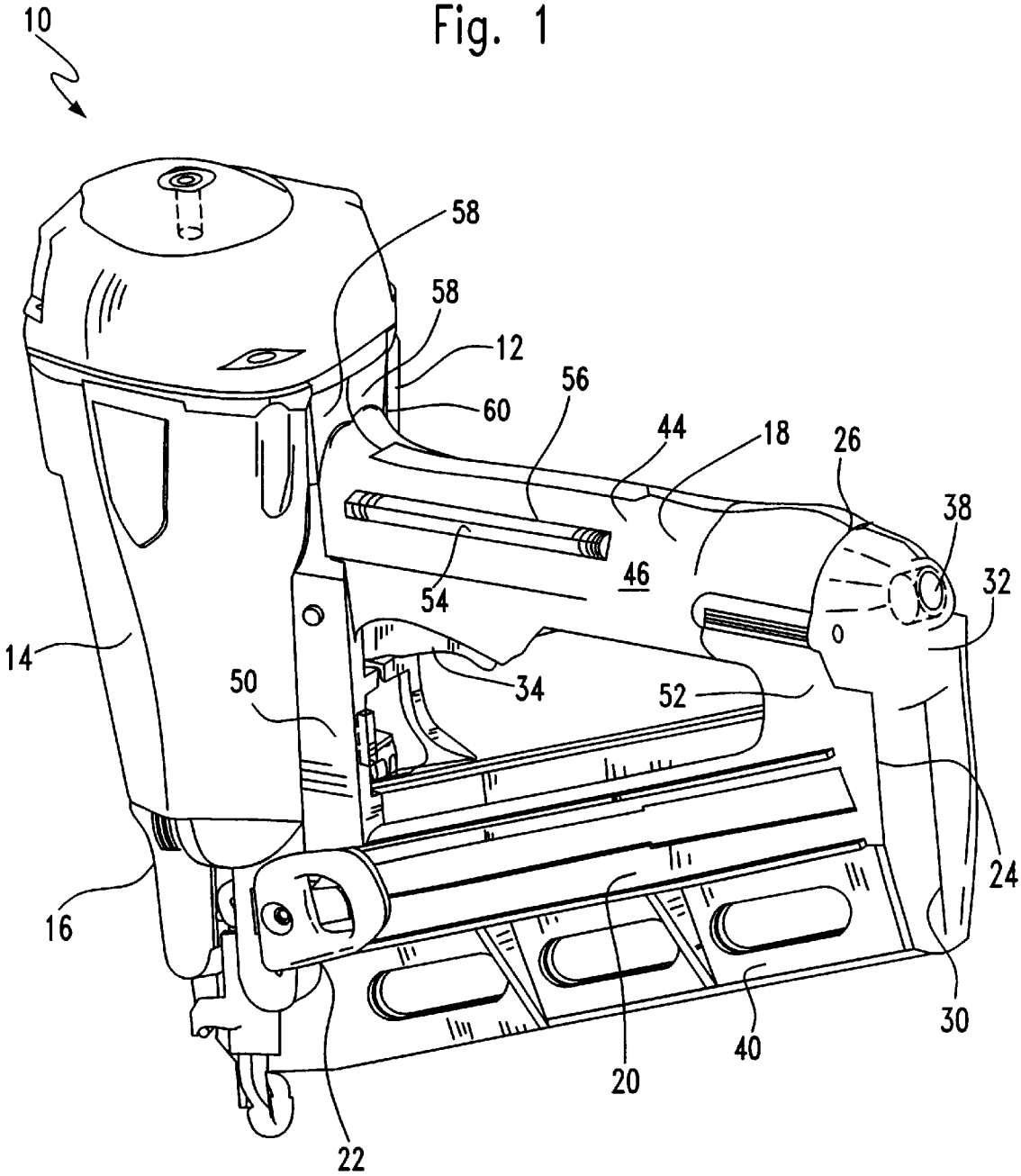
FIG. 1 is a perspective view of an assembled tool suitable for use with the present invention.
Figure 2:
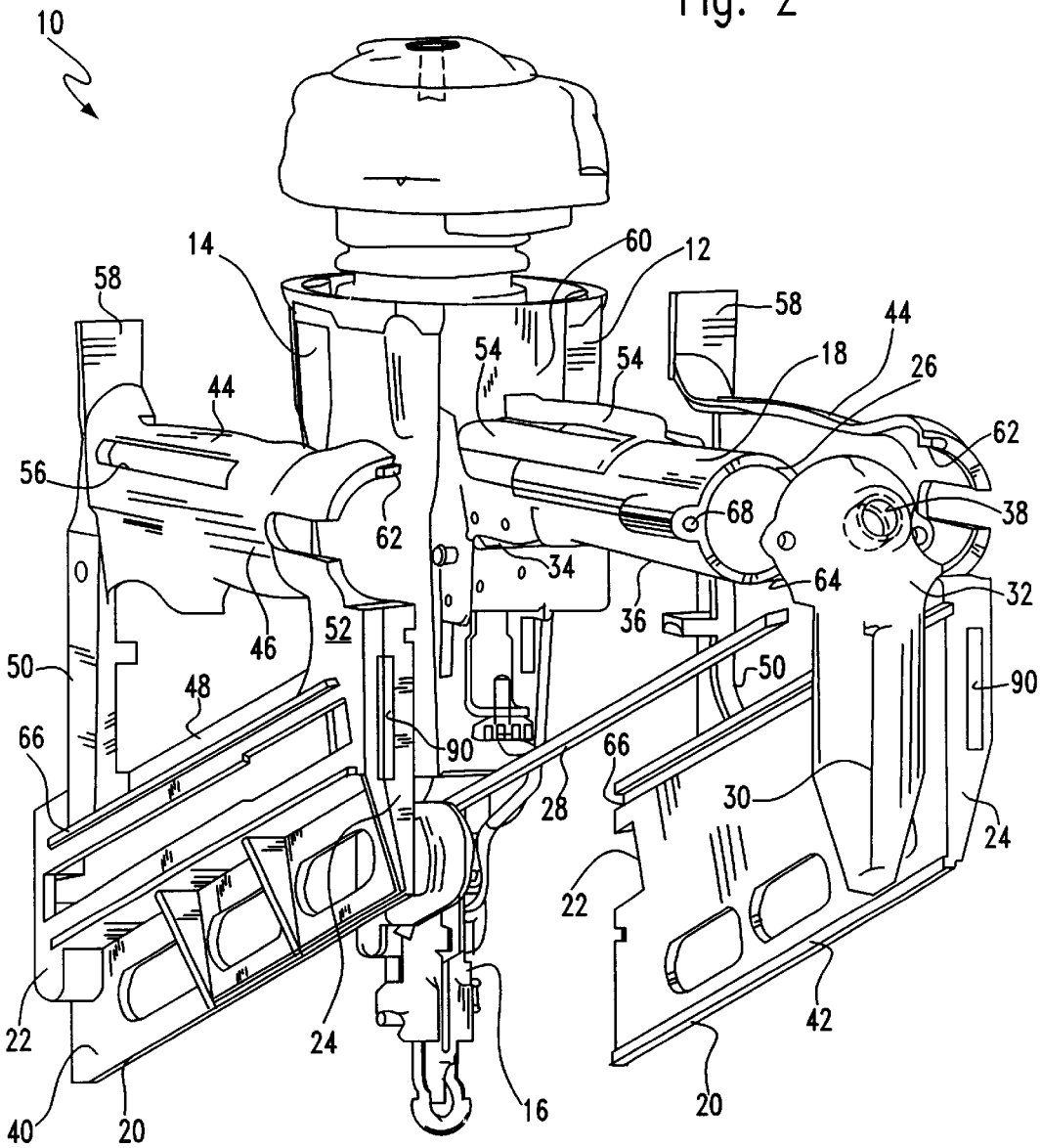
FIG. 2 is an exploded perspective view of the tool of FIG. 1.

Referring now to FIGS. 1 and 2, a fastener driving tool of the type suitable for use with the present invention is generally designated 10, and is depicted as a pneumatic powered tool. However, it is contemplated that the present invention may be used with other types of fastener driving tools, depending on the application, and including combustion, electric, powder-activated tools, as are known in the art. Included with the tool 10 is a housing 12 having a main fastener driving portion 14 with a nosepiece 16 at a lower end. Projecting rearwardly from the fastener driving portion 14 is a handle 18.

A fastener magazine 20 having a driving end 22 and a fastener loading end 24 is connected between the nosepiece 16 and a rear end 26 of the handle 18. As is known in the art, the fastener magazine 20 has a generally "C"-shaped channel 28 (best seen in FIG. 2) configured for slidably receiving at least one linear strip of fasteners (not shown) initially passing through a slot 30 in an endcap 32. Once in the magazine 20, the fasteners are subject to a biasing force which urges them toward the nosepiece 16, where they are sequentially impacted by a reciprocating driver blade and driven into a workpiece. To drive a fastener, the user squeezes a trigger 34 located on an underside 36 of the handle 18.

In the preferred embodiment, the endcap 32 provides the junction point between the rear end 26 of the handle 18 and the rear or loading end 26 of the magazine 20. Since the depicted embodiment is a pneumatic tool, the endcap 32 is also provided with a pressurized air inlet 38 which is configured for receiving a quick connect end of a pressurized air hose (not shown), as is well known in the art.

Referring now to FIG. 2, the tool 10 of FIG. 1 is shown in exploded fashion, and it will be seen that the tool features a pair of clamshells 40, 42 configured to form an ergonomic grip 44 over the handle 18 and also forming the fastener magazine 20, such that the ergonomic grip and the magazine are integral in each clamshell. It will be seen that the clamshells 40, 42 are substantially mirror images of each other, in the depicted embodiment the clamshell 40 being designated the left side, and the clamshell 42 being designated the right side of the grip 44 and the magazine 20. It will also be seen that each clamshell 40, 42 includes a grip portion 46 and a magazine portion 48.

It is preferred that, to preserve the integral structure of each clamshell 40, 42, a generally vertically extending forward support 50 connects the grip portion 46 with the fastener driving end 22 of the magazine 20. Similarly, a generally vertically extending rear support 52 connects the rear end 26 of the handle 18 and the insertion end 24 of the magazine 20.

In the preferred embodiment, each grip portion 46 is constructed and arranged to overlie a portion of the handle 18. Additionally, each grip portion 46 is preferably provided with at least one ergonomic formation 54 to improve the gripping comfort of a user utilizing the tool 10. It is preferred that the clamshells 40, 42 are made of injection molded or thermoformed plastic or other engineered material which is more comfortable to grip than the original metallic housing handle 18. Suitable plastics are ABS, PVC, HDPE, etc., and may vary to suit the application. The ergonomic formations 54 are pad-like pieces of a relatively more resilient or rubber-like material which readily compresses upon gripping, and each are configured to at least partially project through corresponding openings or slots 56 in each grip portion 46. As shown, one such slot 56 is provided to each grip portion 46, however the number and placement of the slots may vary to suit the application. The pads 54 are either secured to undersides of the grip portions 46 or are positioned upon the handle 18 so that a portion projects through the slots 56 upon assembly.

Another important feature of the present invention is that the clamshells 40, 42 are secured to the tool 10 without the use of specialized or designated fasteners specifically provided for securing the clamshells to the tool. To this end, the fastener driving end 22 of each clamshell 40, 42 is provided with a tongue 58 which frictionally engages a recess 60 in the fastener driving portion 14. Upon assembly, adjacent tongues 58 of each of the clamshells 40, 42 create a snap-fit within the recess 60.

Figure 4:
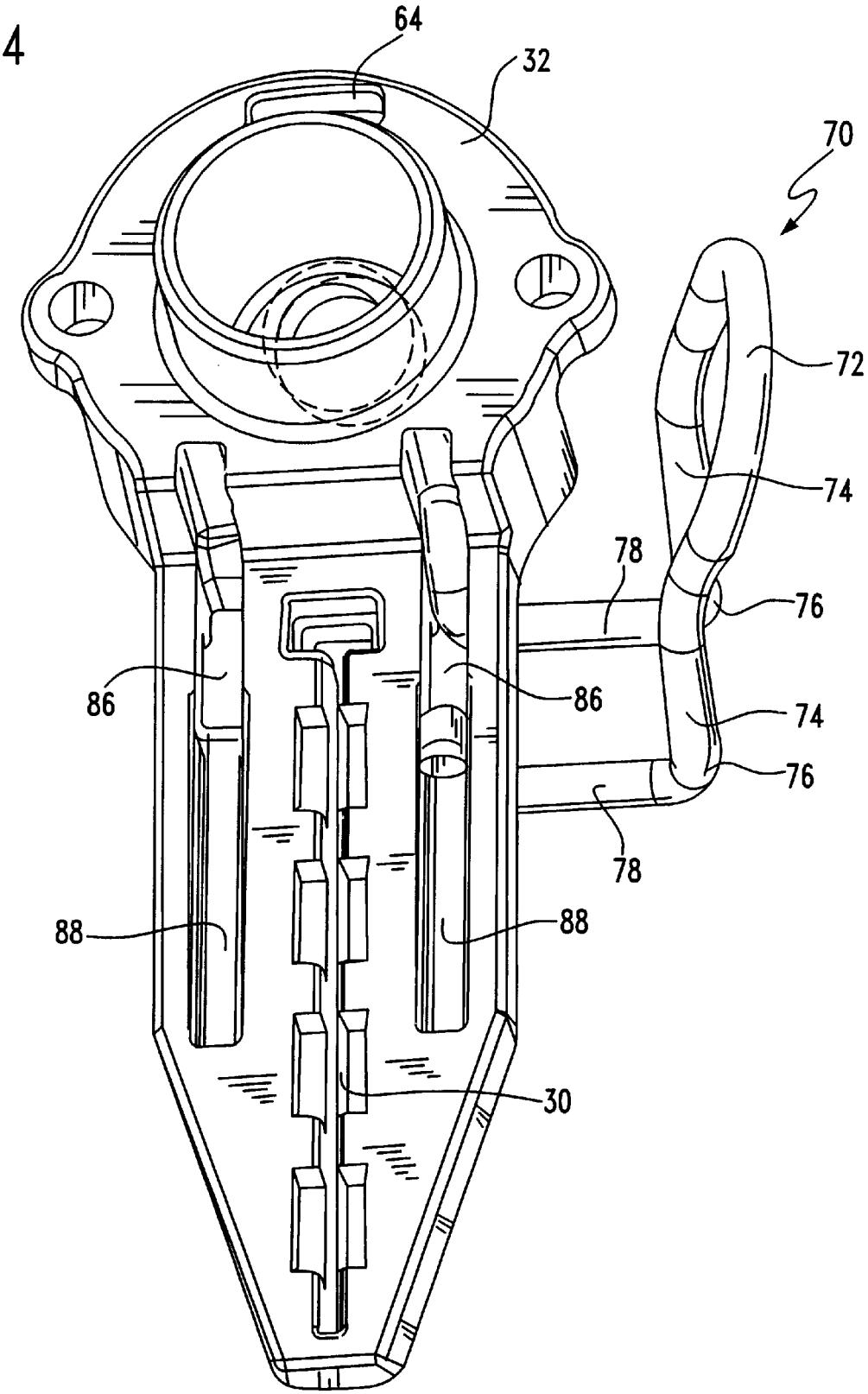
FIG. 4 is a reversed perspective assembled view of the structure of FIG. 3.

At the opposite end of each of the clamshells 40, 42, at least one rearward-projecting tab 62 is constructed and arranged to matingly engage a pocket 64 of the endcap 32 (best seen in FIG. 4). As is the case with the tongues 58, upon assembly the tabs 62 of adjacent clamshells 40, 42 are also adjacent each other. To further stabilize the clamshells 40, 42 upon the tool 10 without designated fasteners, each clamshell 40, 42 defines a nail guide recess 66 configured for receiving a portion of the channel 28. Preferably half of the channel 28 is accommodated in each recess 66. The engagement of the channel 28 in the recess 66 provides a location and alignment point for the two clamshells 40, 42 in both the vertical and horizontal planes. Assembly is completed by securing the endcap 32 to the handle 18 using threaded fasteners (not shown) which are received in threaded bores 68 in the handle 18. This fastening action clamps the clamshells 40, 42 together and upon the tool 10. It is contemplated that threaded fasteners may be provided for securing the two clamshells 40, 42 to each other.

Thus, it will be seen that the provision of the present clamshells 40, 42 provide a simple way to increase the gripping comfort of a tool having an existing handle 18 which is generally cylindrical and made of relatively rigid material. The clamshells are configured to overly the existing handle and are preferably made of a relatively soft plastic for easy gripping. Further, the pad-like ergonomic formations 54 are still more resilient than the overlying gripping portions 46, thus providing two levels of increased gripping ability by the user. At the same time, the assembly of the tool 10 is simplified by incorporating the magazine 20 into the clamshells 40, 42 to combine the gripping portion 46 and the magazine in a single structure in a way that eliminates the need for additional metal brackets and fasteners.

Figure 3:
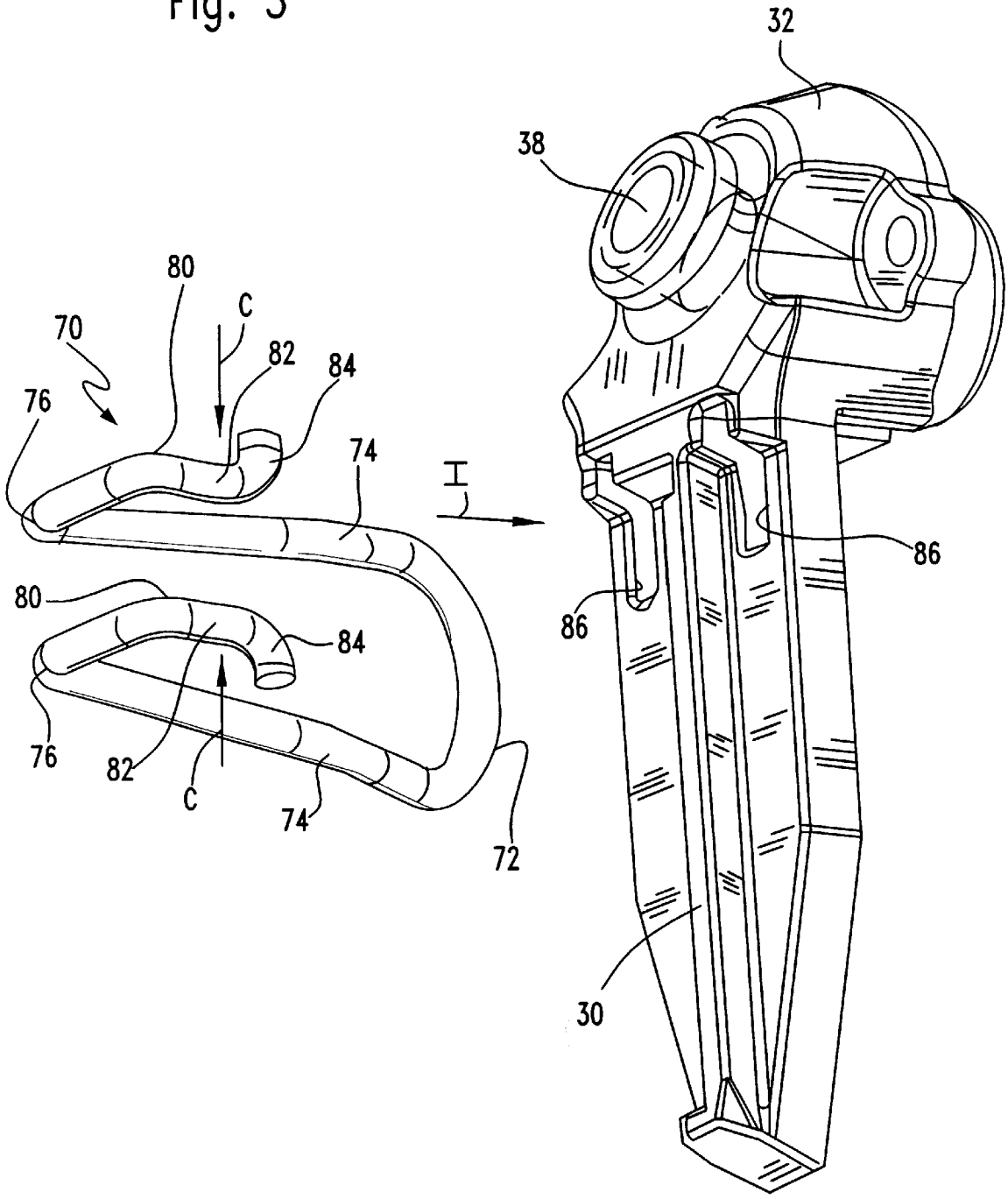
FIG. 3 is an exploded fragmentary perspective view of the tool of FIG. 1 shown with an optional belt hook.

Referring now to FIGS. 3 and 4, another feature of the present tool 10 is a separate belt hook, generally designated 70, which is removable from the tool, and is also easily mountable on either side of the tool to better accommodate various operational requirements, as well as right and left-handed users. More specifically, the belt hook 70 is preferably made of a single piece of heavy wire or rigid, rod-like material forming a "U"-shaped loop portion 72 and two legs 74. Each leg 74 has a first 90° bend 76 in a direction normal to a plane defined by the U-shaped portion, and which defines a leg segment 78. A second 90° bend 80 defines a segment 82 extending in a parallel direction to the plane defmed by the loop 72. Each leg segment 82 also includes an outwardly flaring end bend 84.

The leg segments 82 and the end bends 84 are configured for being inserted into hook slots 86 located on each side of the endcap 32, with the fastener slot 30 located between the two hook slots. As is seen in FIG. 4, the endcap 32 is provided with an expanded cavity 88 behind each hook slot 86 for accommodating the end bends 84. The hook slots 86 are shorter than the natural, uncompressed displacement between the two legs 74, so that the legs must be compressed together in a direction indicated by the arrows "C" to insert the end bends 84 into the hook slots. The rigidity of the belt hook 70 creates a biasing action against this compression.

Upon insertion into the hook slots in the direction indicated by the arrow I, and the subsequent release or the compression force by the user, the biasing action forces the legs 74 apart, resulting in a tightly clamped relationship of the hook 70 in the endcap 32. The hook 70 is secured in the endcap 32 by a combination of the biasing force and the end bends 84, which prevent the hook from being linearly pulled from the tool. It will be seen that the belt hook 70 can be easily released from the endcap by recompressing the legs 74 together and pulling the segments 82 and the end bends 84 from the endcap slots 86. It will also be seen that the belt hook 70 may be easily mounted on either side of the endcap 32 and likewise, on either side of the tool 10.

Referring now to FIG. 2, it will be seen that alternately, slots 90 may be equivalently provided in portions of the clamshells 40, 42. The slots 90 are preferably dimensioned in similar fashion to the hook slots 86, and accommodate the belt hook 70 on either side of the tool 10. By using the belt hook 70 and the slots 86, 88, the user can easily use the tool 10 in tight workspaces without the hook interfering. Then, when the user needs to support or suspend the tool 10 on his belt or some other location, the present portable removable belt hook 70 is easily attached in the selected slots 86, 88 to securely suspend the tool 10 as desired. Once the user wishes to return to fastening, the belt hook 70 is easily removed by squeezing together the legs 74 and pulling the hook from the slots 86, 88.

While a particular embodiment of the fastener driving tool with modular construction of the present invention has been disclosed, it will be appreciated by those skilled in the art that changes and modifications may be made thereto without departing front the invention in its broader aspects and as set forth in the following claims.

What is claimed is:

1. A fastener driving tool, comprising:

a housing including a fastener driving portion and a handle connected to said fastener driving portion; and a pair of clamshells configured to form an ergonomic grip over said handle and also forming a fastener magazine, such that said ergonomic grip and said magazine are integral in each said clamshell.

2. The tool of claim 1 further including at least one relatively resilient ergonomic formation, at least one of said clamshells having at least one opening corresponding to said formation, such that upon assembly of said clamshells upon said tool, said at least one formation projects through said corresponding opening.

3. The tool of claim 2 further including one of said gripping portions for each of said clamshell, each said gripping portion having a plurality of said projections, said gripping portion being constructed and arranged to be disposed between said handle and said clamshells upon assembly of said clamshells upon said tool.

4. The tool of claim 1 further including an endcap for said handle, said clamshells being configured to be secured to said fastener driving portion and said endcap without separate clamshell fasteners.

5. The tool of claim 4 wherein each said clamshell has at least one tab configured for engagement with said endcap.

6. The tool of claim 5 further including a separate belt hook, and a slot on said endcap configured for releasably accommodating said hook in either of a first position or a second position.

7. The tool of claim 1 further including a separate belt hook, and a slot on each of said clamshells configured for releasably accommodating said hook in either of a first position or a second position.

8. A pneumatic fastener driving tool having a pressurized air intake and comprising:

a housing enclosing a fastener driving portion and a handle having a first end connected to said fastener driving portion and a second end connected to said air intake;

a pair of clamshells configured to form an ergonomic grip over said handle and also forming a fastener magazine, such that said ergonomic grip and said magazine are integral in each said clamshell.

9. The tool of claim 8 wherein said handle is generally cylindrical in shape.

10. The tool of claim 8 further including at least one relatively resilient ergonomic formation, at least one of said clamshells having at least one opening corresponding to said formation, such that upon assembly of said clamshells upon said tool, said at least one formation projects through said corresponding opening.

11. The tool of claim 8 further including an endcap for said handle, said clamshells being configured to be secured to said fastener driving portion and said endcap without separate clamshell fasteners.

12. The tool of claim 11 wherein each said clamshell has at least one tab configured for engagement with said endcap.

13. The tool of claim 12 further including a separate belt hook, and a slot on said endcap configured for releasably accommodating said hook in either of a first position or a second position.

14. A fastener driving tool, comprising:

a housing enclosing a fastener driving portion and a handle connected to said fastener driving portion;

a pair of clamshells configured to form an ergonomic grip over said handle and also forming a fastener magazine, such that said ergonomic grip and said magazine are integral in each said clamshell;

an endcap for said handle, said clamshells being configured to be secured to said fastener driving portion and said endcap without separate clamshell fasteners;

a separate belt hook; and a slot on said endcap configured for releasably accommodating said hook in either of a first position or a second position.

15. The tool of claim 14 wherein when said hook is in said first position the hook is disposed on a first side of said tool, and when in said second position, said hook is on a second, opposite side of said tool.

* * * * *